US006786561B1

(12) United States Patent
Glenn

(10) Patent No.: US 6,786,561 B1
(45) Date of Patent: Sep. 7, 2004

(54) TOOL BOX

(76) Inventor: William F. Glenn, 2577 Elysium Ave., Eugene, OR (US) 97401

( * ) Notice: Subject to any disclaimer, the term of this patent is extended or adjusted under 35 U.S.C. 154(b) by 0 days.

(21) Appl. No.: 10/757,617

(22) Filed: Jan. 13, 2004

(51) Int. Cl.[7] ..... A47B 95/02
(52) U.S. Cl. ..... 312/244; 206/372
(58) Field of Search ..... 312/244, 902, 312/287, 245, 352; 206/372, 373, 203, 510, 557, 561; D3/308, 309, 315

(56) References Cited

U.S. PATENT DOCUMENTS 4,341,304 A * 7/1982 Diller ..... 206/349
4,653,713 A * 3/1987 Hamilton ..... 248/238
4,744,613 A * 5/1988 Brantingham et al. .. 312/244 X
5,117,979 A * 6/1992 Brightbill ..... 206/372
D329,135 S * 9/1992 Embree ..... D3/308
6,435,389 B1 8/2002 Sucher

FOREIGN PATENT DOCUMENTS

GB 2241940 * 9/1991

* cited by examiner

*Primary Examiner*—James O. Hansen
(74) *Attorney, Agent, or Firm*—Robert E. Howard

(57) ABSTRACT

A tool box adapted to be positioned onto a joist or beam. The tool box has front and rear end walls attached to right and left side walls, and a handle. A tiered passageway extends between the central portions of the front and rear end walls. The tiered passageway includes an upper passageway tier having a first width, a middle passageway tier having a second width, and a lower passageway tier having a third width. Right and left floor portions extend between the bottom edges of the box side walls and the bottom edges of the lower passageway tier. The third width is greater than the second width, and the second width is greater than the first width. The various widths are adapted to fit over joists and beams of varying width.

4 Claims, 2 Drawing Sheets

TOOL BOX

BACKGROUND OF THE INVENTION

The present invention relates to a tool box. More specifically, it relates to a tool box that can be used by subcontractors installing items in a building under construction prior to flooring being laid down.

Plumbers, for example, install water lines, drain lines, etc. prior to flooring and walls being installed in a structure. It is difficult to set down a tool box in situations where only floor joists or beams are present.

It is an object of the present invention to provide a tool box that can be firmly positioned onto joists and beams.

SUMMARY OF THE INVENTION

The tool box of the present invention is adapted to be positioned onto a joist or beam. The tool box has front and rear end walls attached to right and left side walls, and a handle. A tiered passageway extends between the central portions of the front and rear end walls. The tiered passageway includes an upper passageway tier having a first width, a middle passageway tier having a second width, and a lower passageway tier having a third width. Right and left floor portions extend between the bottom edges of the box side walls and the bottom edges of the lower passageway tier. The third width is greater than the second width, and the second width is greater than the first width. The various widths are adapted to snugly fit over the upper portions of joists and beams of varying width.

DESCRIPTION OF PREFERRED EMBODIMENTS

Figure 1:
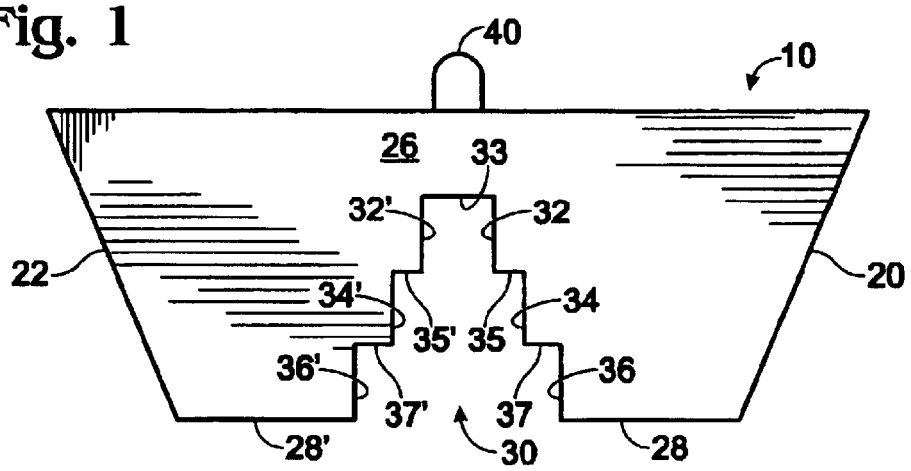
FIG. 1 is an end elevation view of the tool box of the present invention.
Figure 2:
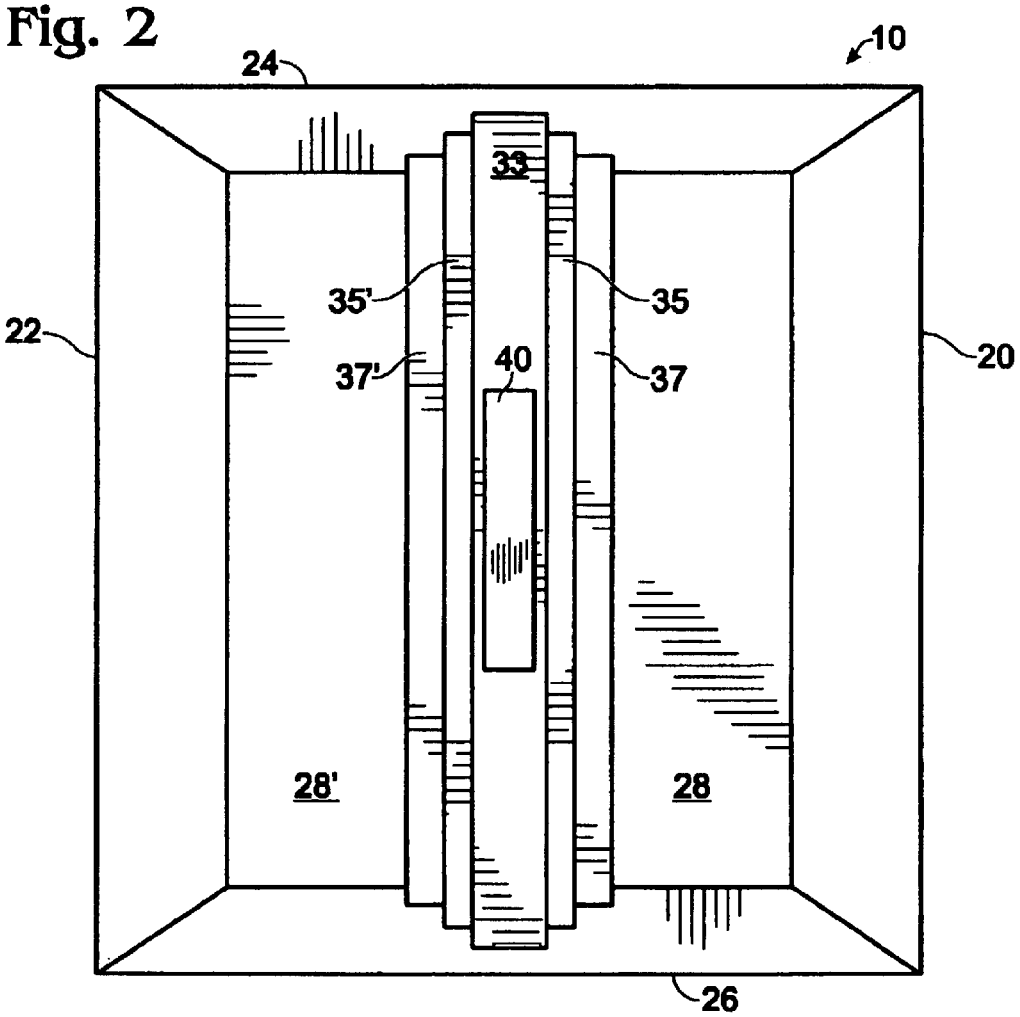
FIG. 2 is a top view of the tool box of the present invention.

The tool box 10 of the present invention has right and left sloping box side walls 20 and 22, front and rear box end walls 24 and 26, and right and left box bottom portions 28 and 28'.

Tool box 10 has a tiered passageway 30 extending between central portions of front and rear box end walls 24 and 26.

An upper passageway tier having a first width is formed by right and left first tier side walls 32 and 32'. First tier side walls 32 and 32' each have upper and lower edges, and extend between front and rear box end walls 24 and 26. A ceiling 33 extends between the upper edges of the right and left first tier side walls 32 and 32', and has an inner surface facing downwardly and an outer surface facing upwardly.

A middle passageway tier having a second width is formed by right and left middle tier side walls 34 and 34'.

Middle tier right and left ledge portions 35 and 35' extend between the upper edges of the right and left middle tier side walls 34, 34' and the lower edges of the right and left first tier side walls 32, 32', respectively.

A lower passageway tier having a third width is formed by right and left lower tier side walls 36 and 36'. Lower tier right and left ledge portions 37, 37' extend between the upper edges of the right and left lower tier side walls 36, 36' and the lower edges of the right and left middle tier side walls 34, 34', respectively.

The third width of the lower passageway tier is greater than the second width of the middle passageway tier, and the second width of the middle passageway tier is greater than the first width of the upper passageway tier. The first, second and third widths are selected to fit over joists and beams of widths commonly encountered in construction. Preferably, the first width would be about 1⅞ inches to snugly fit over the upper portion of a joist having a nominal width of two inches, the second width would be about 2½ inches to snugly fit over the upper portion of a joist having a nominal width of three inches, and the third width would be about 3⅝ inches to snugly fit over the upper portion of a beam having a nominal width of four inches.

Figure 3:
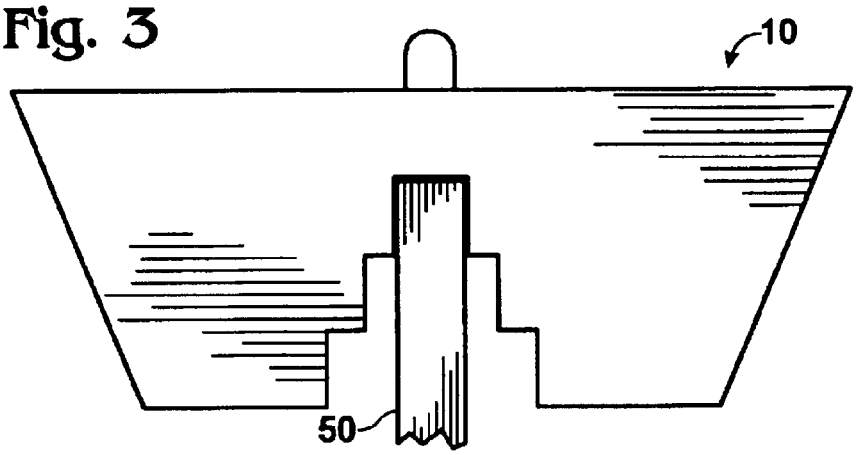
FIG. 3 is an end elevation view of the tool box of the present invention shown positioned on a joist having a first width.
Figure 4:
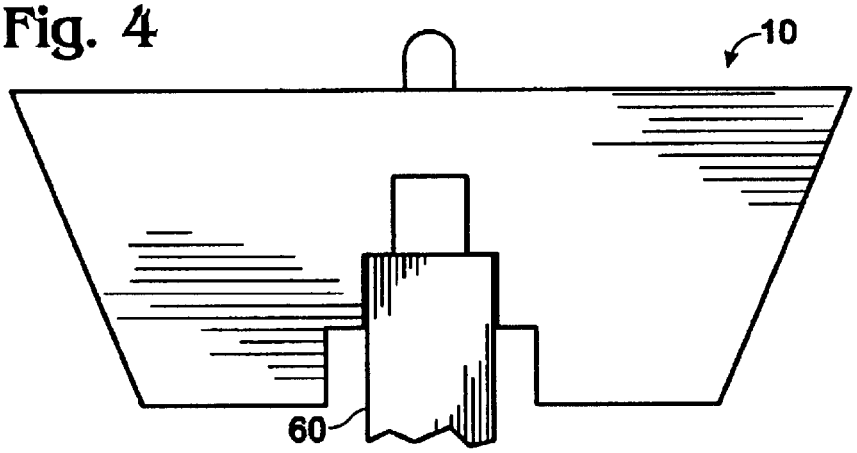
FIG. 4 is an end elevation view of the tool box of the present invention shown positioned on a joist having a second width.
Figure 5:
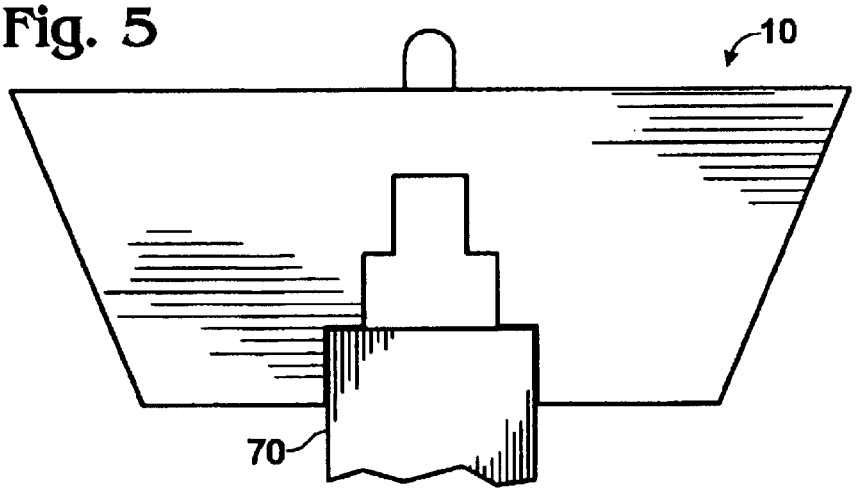
FIG. 5 is an end elevation view of the tool box of the present invention shown positioned on a beam having a third width.

FIGS. 3–5 illustrate the tool box 10 positioned on joists or beams of three different widths. In FIG. 3, the upper passageway tier of tool box 10 is snugly positioned onto the upper portion of joist 50. In FIG. 4, the middle passageway tier of tool box 10 is snugly positioned onto the upper portion of joist 60. In FIG. 5, the lower passageway tier of tool box 10 is snugly positioned onto the upper portion of beam 70.

A handle 40 is attached to a central portion of the outer surface of ceiling 33.

Tool box 10 may be made of separate elements made of wood, metal, plastic, etc., that are attached together by any suitable means, such as gluing, welding or the use of threaded or unthreaded fasteners. Preferably, tool box 10 is made of plastic molded wholly or substantially as a single piece. Herein, whenever the elements of tool box 10 are described as being "attached" to one another it is intended to include attaching separately made elements together or molding all, or substantially all, of the elements together as a single integral structure.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A tool box adapted to be positioned onto a joist or beam comprising:

front and rear end walls attached to right and left side walls;

a tiered passageway extending between said front and rear end walls;

said tiered passageway including an upper passageway tier having a first width, said upper passageway tier having right and left first tier side walls extending between said front and rear box end walls, said right and left first tier side walls each having an upper edge and a lower edge, and a ceiling extending between the upper edges of said right and left first tier side walls, said ceiling having an inner surface and an outer surface;

said tiered passageway including a middle passageway tier having a second width, said middle passageway tier having right and left middle tier side walls extending between said front and rear box end walls, said right and left middle tier side walls each having an upper edge and a lower edge, and middle tier right and left ledge portions extending between the upper edges of said right and left middle tier side walls and the lower edges of said right and left first tier side walls, respectively;

said tiered passageway including a lower passageway tier having a third width, said lower passageway tier having right and left lower tier side walls extending between said front and rear box end walls, said right and left lower tier side walls each having an upper edge and a lower edge, and lower tier right and left ledge portions extending between the upper edges of said right and left lower tier side walls and the lower edges of said right and left middle tier side walls, respectively;

a right floor portion extending between the bottom edge of said right side wall and the bottom edge of said right wall of said lower passageway tier;

a left floor portion extending between the bottom edge of said left side wall and the bottom edge of said left wall of said lower passageway tier; and handle means.

2. The tool box of claim 1 wherein said right and left box side walls slope outwardly from their lower edges to their upper edges.

3. The tool box of claim 1 wherein said handle means is attached to a central portion of said outer surface of said ceiling.

4. The tool box of claim 1 wherein said first width is adapted to snugly receive the upper portion of a joist having a nominal width of two inches, said second width is adapted to snugly receive the upper portion of a joist having a nominal width of three inches, and said third width is adapted to snugly receive the upper portion of a beam having a nominal width of four inches.

* * * * *